US005303134A

United States Patent [19]

Cunado

[11] Patent Number: 5,303,134

[45] Date of Patent: Apr. 12, 1994

[54] LANDSCAPE LIGHTING DEVICE

[76] Inventor: Daniel F. Cunado, 1739 Trosa St., Granada Hills, Calif. 91344

[21] Appl. No.: 918,825

[22] Filed: Jun. 22, 1992

[51] Int. Cl.[5] ..... F21V 19/02

[52] U.S. Cl. ..... 362/372; 362/285; 362/389; 362/417

[58] Field of Search ..... 362/153.1, 287, 288, 362/365, 369, 372, 389, 390, 285, 419

[56] References Cited

U.S. PATENT DOCUMENTS

| | | | |
|---|---|---|---|
| 2,620,434 | 12/1952 | Edmunds | 362/369 |
| 3,246,320 | 4/1966 | Houbolt | 362/365 |
| 3,721,817 | 3/1973 | Contratto | 362/365 |
| 3,980,878 | 9/1976 | Crompton | 362/390 |
| 4,212,051 | 7/1980 | Kulik | 362/369 |
| 4,360,859 | 11/1982 | Ziaylek, Jr. | 362/369 |
| 4,360,861 | 11/1982 | Fitzgerald | 362/369 |
| 4,885,670 | 12/1989 | Baake | 362/390 |
| 4,893,224 | 1/1990 | Tinley | 362/287 |
| 5,183,330 | 2/1993 | Rishel et al. | 362/372 |

*Primary Examiner*—Richard R. Cole
*Assistant Examiner*—Alan B. Cariaso
*Attorney, Agent, or Firm*—John J. Posta, Jr.

[57] ABSTRACT

The improved landscape lighting device suitable for use indoors and outdoors. It is particularly adapted to have the lower end thereof placed in a hole in the ground for low level landscape lighting. A lamp, preferably of the sealed beam type, is releasably held within a flexible, resilient, cylindrical, elastomeric gasket having a sidewall defining an open upper end and open lower end. The inner surface of the gasket is grooved to releasably grip the periphery of the lamp. The exterior surface of the gasket has a plurality of spaced, outwardly extending lugs, preferably in the form of fingers or elongated cylinders, protruding therefrom, which lugs frictionally engage the interior surface of a generally cylindrical, weatherproof housing. The housing has a sidewall defining a central space within which the gasket is disposed. The housing has an open upper end and open lower end. The lugs permit the gasket to be pivoted and tilted in the space, while retaining the lamp in the space, so that the light beam from the lamp can be directionally oriented at will for optimal lighting. The open ended housing and gasket allow water readily to drain therefrom without shorting out the lamp. The lamp is suspended in the housing adjacent the upper end thereof and that upper end is preferably cut away in an arc to facilitate emission of light therefrom, and also to provide a ground-anchoring lip when the tube is inverted.

20 Claims, 2 Drawing Sheets

LANDSCAPE LIGHTING DEVICE

BACKGROUND OF THE INVENTION

1. FIELD OF THE INVENTION

The present invention generally relates to lighting means and more particularly to an improved type of landscape lighting device which can be used indoors and outdoors.

2. PRIOR ART

The usual type of outdoor landscape lighting device currently employed is a hooded lamp connected by a bracket to a ground stake. Although such a device is above the ground, it is still subject to shorting out because the rear end of the hood thereof is closed. Water can enter the hood throught he open front and rest against the rear wiring of the lamp, damaging the lamp.

Even those outdoor landscape lighting devices which are designed to be installed at about ground level are not properly protected from the elements, particularly rain, and are subject to the same deficiencies as those set forth for the above-ground lighting devices described above. Indoor landscape lighting devices used in, for example, greenhouses, etc., which are watered are subject to the same problems.

Moreover, most individual outdoor landscape lighting devices must be initially carefully positioned, because they have no means of reorientating the light projected therefrom. Those devices which have swivel brackets and the like for orientation of the light beams are expensive and subject to malfunction due to rusting and the like.

Accordingly, there is a need for an improved, inexpensive, durable and efficient indoor and outdoor landscape lighting device which easily and effectively reorients a beam of light issuing therefrom and also protects the lamp thereof from shorting out due to the intrusion of water into the device. Preferably, the device has simple means for installing the device at about ground level for maximum effectiveness.

SUMMARY OF THE INVENTION

The improved indoor and outdoor landscape lighting device of the present invention satisfies all the foregoing needs. The device is substantially as set forth in the Abstract of the Disclosure.

Thus, the device comprises a housing in the form of an elongated generally cylindrical tube having an open upper end and open lower end, and a sidewall defining a central space communicating with the two ends. The housing is of weather-resistant material, such as weatherproofed wood, plastic, coated metal, ceramic or cermet.

The device also includes an electrical lamp, preferably of the sealed beam type, and a gasket. The gasket is of a flexible resilient elastomer and is generally cylindrical, with an open upper end and an open lower end, and a sidewall defining a central cavity in communication with both ends of the gasket. The inner surface of the gasket bears spaced grooves, with lands therebetween, and strongly but releasably grips the lamp, holding it in place in the device.

The outer surface of the gasket has a plurality of spaced lugs extending outwardly therefrom. The lugs are flexible and resilient and preferably in the form of elongated fingers or elongated cylinders. The lugs frictionally grip the inner surface of the housing sidewall to releasably hold the gasket and lamp in place in the housing space, preferably adjacent the upper end thereof, and in any event above the bottom thereof, so that ground water and rain run-off cannot rest against the rear of the lamp and the wiring connected thereto to damage and short them out.

The lugs allow the gasket and thus the lamp to be pivoted and tilted at will in the housing to change the direction of the beam of light projected by the lamp up through the upper end of the housing. Accordingly, the lamp beam can be aimed for optimal effect in lighting bushes and other landscape, plantings, walkways, etc.

The lower end of the housing can be placed in a ground hole, trench, slot or the like and yet keep the housing interior free of water. No mounting bracket is needed, so that installation of the device is rapid and efficient.

Further features of the improved device of the present invention are set forth in the following detailed description and accompanying drawings.

DRAWINGS

DETAILED DESCRIPTION

FIGS. 1-7

Figure 1:
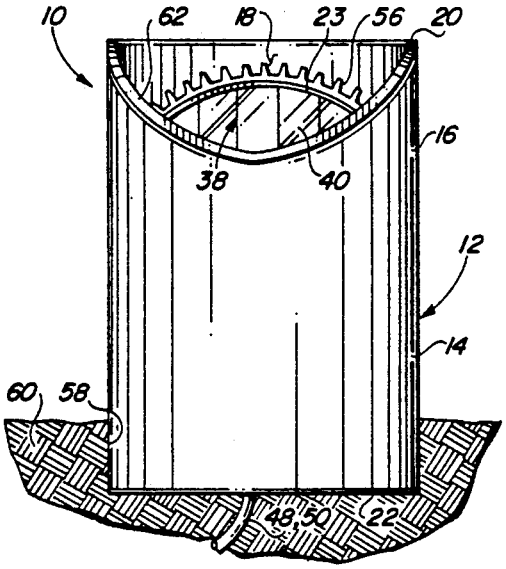
FIG. 1 is a schematic front elevation of a preferred embodiment of the improved landscape lighting device of the present invention, shown with the lower end of the device disposed in a hole in the ground.

Now referring more particularly to FIGS. 1-7 of the drawings, a preferred embodiment of the improved outdoor landscape lighting device of the present invention is schematically depicted therein. Thus, device 10 is shown, which comprises a preferably about cylindrical housing 12 in the form of a rigid, elongated self-supporting tube 14 having a sidewall 16 defining a central space 18 communicating with the open upper end 20 and the open lower end 22 of tube 14. Tube 14 is of weather-resistant material such as weatherproofed wood, coated metal, ceramic, hardened rubber, plastic, cermet or the like.

Device 10 also includes a generally cylindrical hollow tubular gasket 23 which is flexible, resilient and formed of natural or synthetic rubber or plastic elastomer. Gasket 23 has a sidewall 24 which defines a central cavity 26 communicating with open upper end 28 and open lower end 30 of gasket 23. The inner surface 32 of sidewall 24 has a plurality of spaced transverse grooves 34 separated by lands 36.

Grooves 34 releasably and firmly grip the outer periphery of an electrical lamp 38, preferably of the sealed beam type, holding it in place in gasket 23 so that a light beam therefrom can pass out upper end 28.

Figure 4:
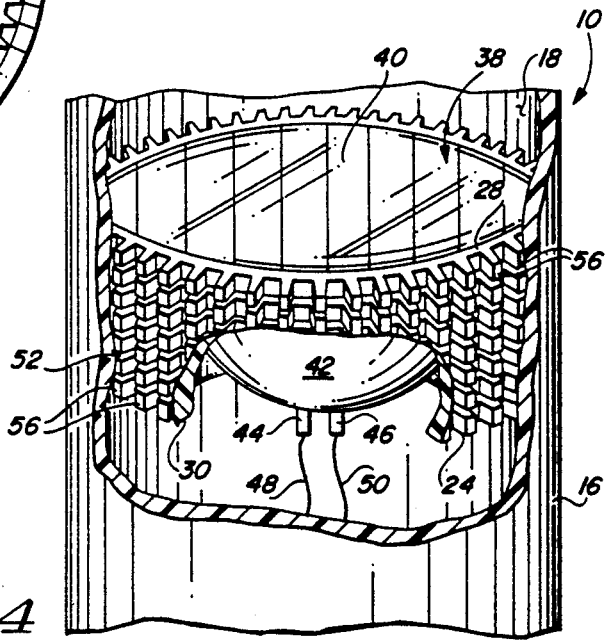
FIG. 4 is a schematic front elevation, partly broken away, of the device of FIG. 1.
Figure 5:
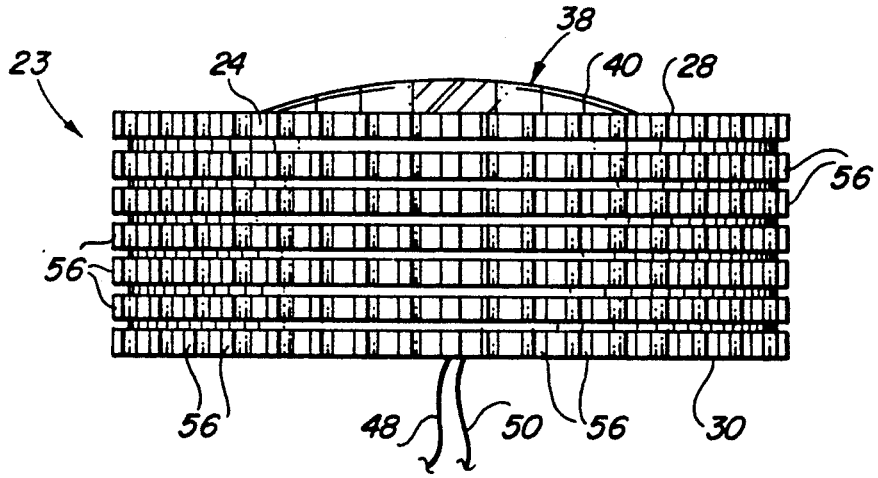
FIG. 5 is a schematic side elevation of the gasket of the device of FIG. 1, showing its exterior surface.
Figure 6:
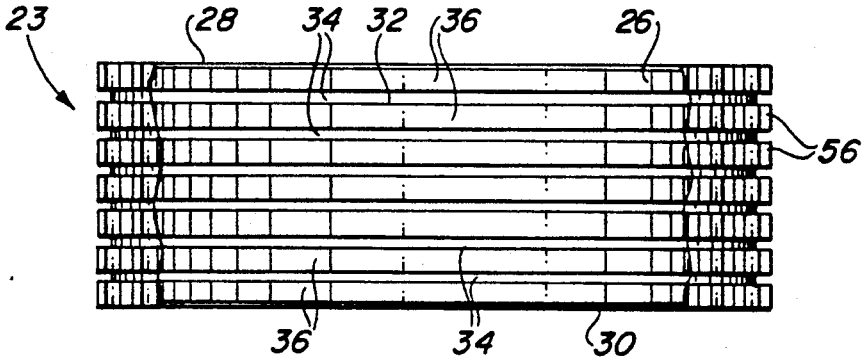
FIG. 6 is a schematic side elevation, partly broken away, of the gasket of the device of FIG. 1, showing its interior surface.

Lamp 38, as shown in FIG. 4, includes a circular (in top plan view) front curved glass cover or beam focuser 40 connected to a metal body and rim 42. Metal rear electrical connectors 44 and 46 are connected to electrical leads 48 and 50, respectively. Moreover, grooves 34 seal lamp 38 in gasket 23 to prevent water from running down between lamp 38 and gasket 23. Therefore, connector 44 and 46 and leads 48 and 50 are protected from corrosion and shorting out.

The outer diameter of gasket 23 is dimensioned so that the outer surface 52 of sidewall 24 of gasket 23 frictionally engages but can be removed from the inner surface 54 of sidewall 16 of tube 14, so that gasket 23 and lamp 38 enclosed in gasket 22 are releasably held within tube 14, specifically in space 18, in an orientation so that a beam of light from lamp 38 passes up out of open upper end 20 of housing 12.

Figure 7:
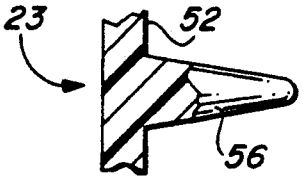
FIG. 7 is an enlarged schematic side elevation of a lug finger of the gasket of the device of FIG. 1; and, FIG. 8 is an enlarged schematic side elevation of a modified form of a lug of the gasket of the device of the present invention.

In order to provide the necessary gripping function, outer surface 52 of gasket 23 includes a plurality of spaced peripherally outwardly extending elongated and tapered lugs or fingers 56 (FIG. 7). Fingers 56 are sufficiently long and flexible and made of elastomeric material such that they can be mashed over and bent to tilt or angle gasket 23 (and thus lamp 38) at will in tube 14, yet hold it in place, thus readily controlling the orientation of a beam of light passing from lamp 38 out of housing 12. To further facilitate such orientation and reorientation, the outer diameter of gasket 23 may slightly decrease from upper end 28 to lower end 30.

Figure 2:
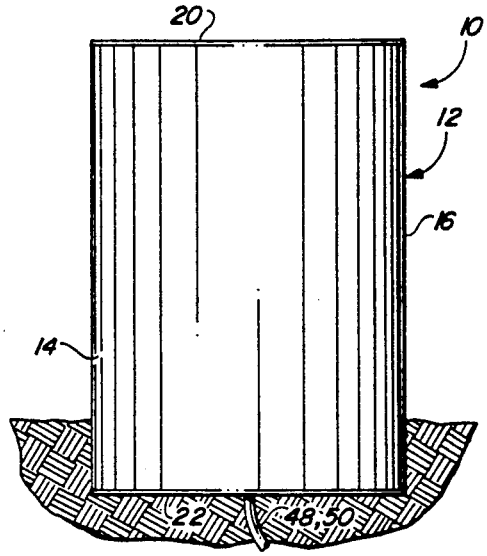
FIG. 2 is a schematic rear elevation of the device of FIG. 1.
Figure 3:
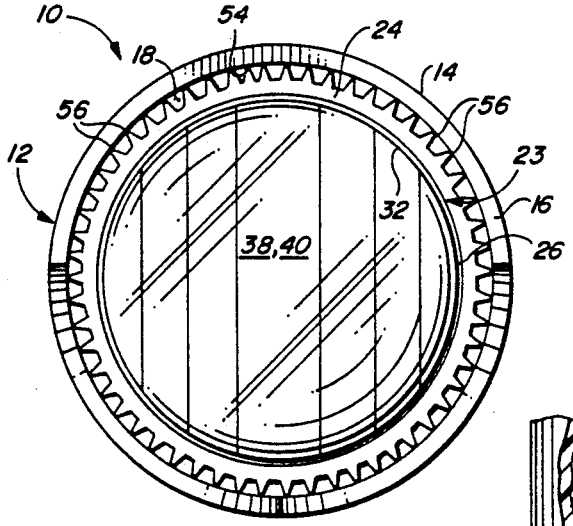
FIG. 3 is a schematic top plan view of the device of FIG. 1.

As shown in FIGS. 1 and 2, lower end 22 of housing 10 may be mounted into an effective landscape-lighting position by inserting it into a hole, slot or trench 58 in the ground 60, rather than being connected to a ground stake or the like (not shown). This not only simplifies the construction and installation of device 10 but allows it to be angled at any desired orientation during installation and with lamp 38 at any desired height above the ground 60, in contrast to conventional landscape lighting devices.

It will be understood that although the primary use of device 10 is to light outdoor landscapes, walkways and the like, device 10 can just as easily be used indoors, for example, in open or closed atriums, greenhouses, etc. In order to provide an improved decorative effect, upper end 20 of housing 12 may have an arcuate front cutaway portion 62 (FIG. 1) to partially expose glass cover 40.

As shown in FIG. 1, lamp 38 and gasket 23 are angled in housing 12. Lamp 38 and gasket 23 can be positioned at any height in tube 14, as desired, but with lamp 38 well above lower end 22 of tube 14 to keep it free of ground water.

Since tube 14 and gasket 23 are double open-ended, water, such as rain, entering housing 12 can drain readily down therethrough, to prevent shorting out and corroding lamp 38. Because fingers 56 are spaced apart, water can easily flow down housing 12 between tube 14 and gasket 23 for good drainage. Yet, as previously noted, grooves 34 seal lamp 38 in gasket 23 against moisture.

If desired, tube 14 can be inverted so that the lip 64 formed by cut-away portion 62 in end 20 can serve as means for anchoring housing 12 in hole 58 in the ground 60. In such event, gasket 23 and lamp 38 will be reversed within tube 14 so that lamp 38 now points out end 22 which now becomes the upper end of tube 14.

Accordingly, device 10 is simple, durable, inexpensive and efficient. It can be rapidly mounted and the light beam from lamp 38 can be oriented and re-oriented as desired for maximum effectiveness. Wire leads 48 and 50 pass out lower end 22 to a suitable electrical power source (not shown).

FIG. 8

Figure 8:
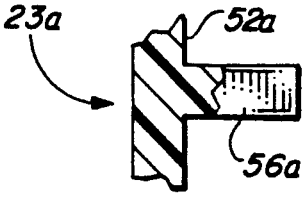

A modified form of the fingers used for gripping means on the exterior surface of gasket 23 is shown schematically in FIG. 8. Thus, finger **56*a* is shown, which can be substituted for each finger 56, as desired, and which is elongated and cylindrical. Finger 56*a* is otherwise identical to finger 56**.

Various other modifications, changes, alterations and additions can be made in the improved landscape lighting device of the present invention, its components and parameters. All such modifications, alterations, substitutions and additions as are within the scope of the appended claims form part of the present invention.

What is claimed is:

1. An improved landscape lighting device, said device comprising, in combination:

a) a housing comprising an elongated generally cylindrical tube having a sidewall defining a central space, said sidewall having exterior and interior surfaces, said tube having an open upper end and an open opposite lower end communicating with said central space;

b) a lamp in said central space for projecting light from said upper end of said tube; and, c) a flexible resilient gasket in said central space, releasably holding and disposed around said lamp and holding said lamp in said central space, said gasket comprising a generally cylindrical member comprising a sidewall defining a central cavity, said gasket having opposite open upper and lower ends communicating with said central cavity, in which cavity is held said lamp by said gasket, said gasket sidewall having an exterior surface comprising a plurality of flexible, resilient lugs radiating outwardly thereof, said lugs comprising fingers individually disposed about said sidewall at a series of discrete locations extending vertically and horizontally about said sidewall, each said finger capable of being flexed in both horizontal and vertical directions about said sidewall, whereby the ends of said lugs contact and frictionally grip the interior surface of said housing sidewall, said lugs permitting said gasket to be substantially rotated and pivoted in said space for adjustable horizontal and vertical directional orientation of a light beam emitted from said lamp.

2. The lighting device of claim 1 wherein said device is for outdoor use and wherein said housing comprises weather-resistant material, the lower end of which is adapted to be seated in a hole in the ground.

3. The lighting device of claim 2 wherein said housing comprises plastic.

4. The lighting device of claim 2 wherein said gasket comprises elastomeric material selected from the group consisting of natural rubber, synthetic rubber, plastic and mixtures thereof.

5. The improved lighting device of claim 1 wherein said lugs cover substantially the entire exterior surface of said gasket sidewall.

6. The lighting device of claim 5 wherein said lugs are substantially uniformly displaced from one another.

7. An improved landscape lighting device, said device comprising, in combination:

a) a housing comprising an elongated generally cylindrical tube having a sidewall defining a central space, said sidewall having exterior and interior surfaces, said tube having an open upper end and an open opposite lower end comjunicating with said central space;

b) a lamp in said central space for projecting light from said upper end of said tube;

c) a flexible resilient gasket in said central space, releasably holding and disposed around said lamp and holding said lamp in said central space, said gasket comprising a generally cylindrical member comprising a sidewall defining a central cavity, said gasket having opposite open upper and lower ends communicating with said central cavity, in which cavity is held said lamp by said gasket, said gasket sidewall having an exterior surface comprising a plurality of flexible, resilient lugs extending outwardly thereof, contacting and frictionally gripping the interior surface of said housing sidewall, said lugs permitting said gasket to be pivoted in said space for adjustable directional orientation of light emitted from said lamp, said lugs comprising fingers individually disposed about said sidewall at a series of discrete locations extending vertically and horizontally about said sidewall, each said finger capable of being flexed in both horizontal and vertical directions about said sidewall; and d) wherein said device is for outdoor use and wherein said housing comprises weather-resistant material, the lower end of which is adapted to be seated in a hole in the ground.

8. The improved outdoor landscape lighting device of claim 7 wherein said housing comprises plastic.

9. The improved outdoor landscape lighting device of claim 7 wherein said gasket comprises elastomeric material selected from the group consisting of natural rubber, synthetic rubber, plastic and mixtures thereof.

10. An improved landscape lighting device, said device comprising, in combination:

a) a housing comprising an elongated generally cylindrical tube having a sidewall defining a central space, said sidewall having exterior and interior surfaces, said tube having an open upper end and an open opposite lower end communicating with said central space;

b) a lamp in said central space for projecting light from said upper end of said tube;

c) a flexible resilient gasket in said central space, releasably holding and disposed around said lamp and holding said lamp in said central space, said gasket comprising a generally cylindrical member comprising a sidewall defining a central cavity, said gasket having opposite open upper and lower ends communicating with said central cavity, in which cavity is held said lamp by said gasket, said gasket sidewall having an exterior surface comprising a spaced plurality of flexible, resilient lugs radiating outwardly thereof, whereby the ends of said lugs contact and frictionally grip the interior surface of said housing sidewall, said lugs permitting said gasket to be substantially rotated and pivoted in said space for adjustable horizontal and vertical directional orientation of a light beam emitted from said lamp;

d) wherein said device is for outdoor use and wherein said housing comprises weather-resistant material, the lower end of which is adapted to be seated in a hole in the ground;

e) wherein said gasket comprises elastomeric material selected from the group consisting of natural rubber, synthetic rubber, plastic and mixtures thereof; and f) wherein said gasket lugs comprise fingers and wherein said gasket has an interior surface bearing a plurality of spaced annular lands and grooves tightly but releasably holding said lamp in said cavity of said gasket.

11. The improved outdoor landscape lighting device of claim 10 wherein the sidewall of said housing at said upper end has a portion thereof cut away to provide an arcuate aperture for improved lighting with said device and for decorative and anchoring purposes.

12. The improved outdoor landscape lighting device of claim 10 wherein said lamp is of a sealed beam type.

13. The improved outdoor landscape lighting device of claim 12 wherein said housing comprises material selected from a group consisting of plastic, hard rubber, ceramic, weather-treated wood, ceramic, cermet, coated metal and mixtures thereof.

14. The improved outdoor landscape lighting device of claim 12 wherein said lamp is positioned by said gasket adjacent said housing upper end and above said housing lower end.

15. The improved outdoor landscape lighting device of claim 10 wherein said lugs are generally elongated cylinders.

16. An improved landscape lighting device, said device comprising, in combination:

a) a housing comprising an elongated generally cylindrical tube having a sidewall defining a central space, said sidewall having exterior and interior surfaces, said tube having an open upper end and an open opposite lower end communicating with said central space;

b) a lamp in said central space for projecting light from said upper end of said tube;

c) a flexible resilient gasket in said central space, releasably holding and disposed around said lamp and holding said lamp in said central space, said gasket comprising a generally cylindrical member comprising a sidewall defining a central cavity, said gasket having opposite open upper and lower ends communicating with said central cavity, in which cavity is held said lamp by said gasket, said gasket sidewall having an exterior surface comprising a spaced plurality of flexible, resilient lugs radiating outwardly thereof, whereby the ends of said lugs contact and frictionally grip the interior surface of said housing sidewall, said lugs permitting said gasket to be substantially rotated and pivoted in said space for adjustable horizontal and vertical directional orientation of a light beam emitted form said lamp;

d) wherein said device is for outdoor use and wherein said housing comprises weather-resistant material, the lower end of which is adapted to be seated in a hole in the ground;

e) wherein said gasket comprises elastomeric material selected from the group consisting of natural rubber, synthetic rubber, plastic and mixtures thereof;

f) wherein said gasket lugs comprise fingers and wherein said gasket has an interior surface bearing a plurality of spaced annular lands and grooves tightly but releasably holding said lamp in said cavity of said gasket.

17. The lighting device of claim 16 wherein the sidewall of said housing at said upper end has a portion thereof cut away to provide an arcuate aperture for improved lighting with said device and for decorative and anchoring purposes.

18. The lighting device of claim 16 wherein said lamp is of the sealed beam type.

19. The lighting device of claim 18 wherein wherein said housing comprises material selected from the group consisting of plastic, hard rubber, ceramic, weather-treated wood, ceramic, cermet, coated metal and mixtures thereof.

20. The lighting device of claim 18 wherein said lamp is positioned by said gasket adjacent said housing upper end and above said housing lower end.

* * * * *